United States Patent [19]

Harris et al.

[11] 4,076,501

[45] Feb. 28, 1978

[54] CORROSION INHIBITION OF WATER SYSTEMS WITH PHOSPHONIC ACIDS

[75] Inventors: Arthur Harris, Poynton; John Burrows, Congleton; James Roger Hargreaves, Sale, all of England

[73] Assignee: Ciba-Geigy Corporation, Ardsley, N.Y.

[21] Appl. No.: 653,805

[22] Filed: Jan. 28, 1976

Related U.S. Application Data

[63] Continuation of Ser. No. 557,569, Mar. 11, 1975, abandoned, which is a continuation of Ser. No. 265,139, Jun. 22, 1972, abandoned.

[30] Foreign Application Priority Data

Jun. 26, 1971 United Kingdom ..... 30063/71

[51] Int. Cl.[2] ..... C23F 11/16

[52] U.S. Cl. ..... 21/2.7 A; 106/14; 252/389 A; 260/502.5

[58] Field of Search ..... 21/2.7 A; 252/389 A

[56] References Cited

U.S. PATENT DOCUMENTS

| | | | |
|---|---|---|---|
| 3,346,488 | 10/1967 | Lyons | 260/502.5 X |
| 3,483,133 | 12/1969 | Hatch | 252/389 A |
| 3,668,138 | 6/1972 | Hoover | 252/389 A X |
| 3,718,603 | 2/1973 | Mitchell | 260/502.5 X |
| 3,803,047 | 4/1974 | Hwa | 21/2.7 A X |
| 3,809,694 | 5/1974 | Redmore | 21/2.7 A |
| 3,837,803 | 9/1974 | Carter | 21/2.7 A |
| 3,901,651 | 8/1975 | Benner | 21/2.7 A |
| 3,974,090 | 8/1976 | Mitchel | 21/2.7 A X |

FOREIGN PATENT DOCUMENTS 1,201,334 8/1970 United Kingdom.

OTHER PUBLICATIONS

K. Moedritzer et al., J. Org. Chem. 31(5), 1603–1607 (1966).

*Primary Examiner*—Sidney Marantz
*Attorney, Agent, or Firm*—Luther A. R... Hall

[57] ABSTRACT

Process for inhibiting corrosion by corrosive water systems on metals which comprises adding to the water systems a phosphcnic acid having the general formula:

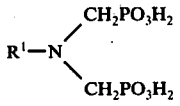

wherein $R^1$ is a straight chain alkyl group having 1–5 carbon atoms, an alkenyl group having 3–5 carbon atoms in which the double bond is not adjacent to the nitrogen atom, a tolyl group, a benzyl group or a cyclohexyl group.

7 Claims, No Drawings

CORROSION INHIBITION OF WATER SYSTEMS WITH PHOSPHONIC ACIDS

This is a Continuation of application Ser. No. 557,569, filed on Mar. 11, 1975, now abandoned, which is a Continuation of application Ser. No. 265,139, filed on June 22, 1972, now abandoned.

In British Specification No. 1201334 there is described and claimed a process for inhibiting corrosion of corrosive water systems which comprises incorporating a phosphonic acid of the general formula:

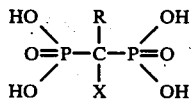

I wherein R is an alkyl group containing up to 11 carbon atoms and X is an OH or $NH_2$ group, or a water-soluble salt thereof; or of the general formula:

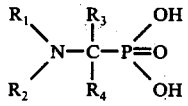

II wherein $R_1$, $R_2$, $R_3$ and $R_4$ are each hydrogen or alkyl groups and may be the same or different, or $R_1$ and/or $R_2$ may be:

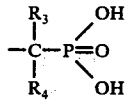

III or alkyl ether groups, or a water soluble salt thereof; or of the general formula:

$$[(HO)_2OPR_4R_3C]_2N\text{-}(CH_2)_x\text{-}N[CR_3R_4PO(OH)_2]_2 \qquad \text{IV}$$

wherein $R_3$ and $R_4$ have the values set out above and $x$ has a value of from 1 to 3, or a water soluble salt thereof.

In that specification corrosive water systems are defined as systems in which water exerts a corrosive attack on metals, but does not tend to deposit a calcareous scale, and a distinction is drawn between the three different types of water treatment there mentioned, namely, sequestration, threshold treatment and corrosion inhibition. It is stated that corrosion inhibition is commonly applied to soft water systems which tend to exert a chemical attack on metal substrates, and involves the addition of small proportions of inhibitor (typically about 20 ppm.). It differs from both sequestraton and threshold treatment in that the anti-corrosive agent acts on the metal surface to protect it, whereas in the other treatments the agents acts on dissolved cations, either complexing them, so that they are rendered chemically innocuous to soap, or inhibititing the readiness with which they precipitate out as scale. A difference is that corrosion inhibition is customarily applied to acidic soft waters which do not tend to deposit calcareous scale, whereas the other treatments are intended for use with hard, or scale forming water. Corrosion inhibition further differs from sequestration in that only very small concentrations of the agent are required.

There are only two compounds, specifically named in Specification No. 1201334 as examples of the corrosion inhibitors broadly claimed, and these are 1,1-hydroxyethylidene-diphosphonic acid as an example of formula I, and amino-tris (methylene phosphonic acid) as an example of formula II. We have now surprisingly found that certain other compounds falling within the broad scope of formulae I and II have ominently superior properties to the ones exemplified, and that these superior properties are also shown by other compounds not even generically covered.

According to this invention, therefore, a process for inhibiting the attack of a corrosive water system on metals with which it comes into contact comprises incorporating in the system a phosphonic acid of the general formula:

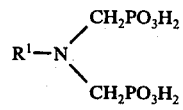

V in which $R^1$ is a straight-chain alkyl group containing from 1 to 5 carbon atoms, an alkenyl group containing from 3 to 5 carbon atoms in which the double bond is not adjacent to the nitrogen atom, a tolyl group, a benzyl group or cyclohexyl group, or a water-soluble salt thereof.

The compounds of formula V in which $R^1$ is a methyl, n-propyl, allyl or cyclohexyl group, have been found to be particularly active as corrosion inhibitors $CH_3—N\ (CH_2PO_3H_2)_2$ $n—C_3H_7—N\ (CH_2PO_3H_2)_2$ $CH_2{=}CHCH_2—N\ (CH_2PO_3H_2)_2$

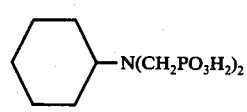

The proportion of corrosion inhibitor to be added to a corrosive water system will of course depend on the nature of the water, some systems being much more corrosive than others. In general we find that we do not require more than 200 parts per million, and in the majority of cases considerably less will suffice, for example, from 5 to 50 ppm, or even 5 to 15 ppm.

Some test results will now be given, all parts and proportions being by weight unless otherwise stated. The test procedure was as follows:

A stock solution of the inhibitor is diluted to 100 ppm using a water prepared by dissolving 20 grams $CaSO_4.2H_2O$
15 grams $MgSO_4.7H_2O$
4.6 grams $NaHCO_3$
7.7 grams $CaCl_2.6H_2O$ in 45 gallons of distilled water. The measured pH of the water is 6.8 and the calculated $PH_S$ is 8.4. Thus the water is corrosive within the definition of Specification No. 1,201,334.

A mild steel test coupon (5 × 2.5 cms.) which has been scrubbed with pumice, dipped in 6N hydrochloric acid for 1 minute, dried and weighed is suspended below the surface of 100 mls. of the solution. The solution is then stored at 40° C in a thermostated water bath.

During the storage period the solution is continuously aerated by passing air (500 mls/min) through a nozzle screened from the metal surface by a glass chimney. Water losses caused by evaporation are continuously replenished with distilled water dispensed from a constant level device.

After 48 hours the metal specimen is removed, scrubbed with pumice, dipped in inhibited hydrochloric acid for 1 minute and reweighed.

It should be noted that this test procedure is considerably more severe than that described in British Specification No. 1201334. In that specification, 20 sq. cm. of metal surface are immersed in 18 liters of water containing 10 ppm. of inhibitor, equivalent to 9 mg. of inhibitor per sq. cm. of surface. In our procedure we use 25 sq. cm. of metal surface in 100 ml. of water containing 100 ppm. of inhibitor, that is 0.4 mg. of inhibitor per sq. cm. of metal surface. This increase in severity enables us to differentiate more conclusively between inhibitors of different effectiveness.

Each test and the blanks were done in duplicate, and the results are expressed as percentage inhibition compared with blank tests with no inhibitor present, that is to say the reduction in corrosive attack observed.

The results are shown in Table I.

TABLE 1

| No. | Compound Tested | % Inhibition observed |
|---|---|---|
| 1 | $N(CH_2PO_3H_2)_3$ | 28 |
| 2 | 1,1,3,3 tetra methyl butyl $N(CH_2PO_3H_2)_2$ | 18 |
| 3 | $n\text{-}C_8H_{17} . N(CH_2PO_3H_2)_2$ | 0 |
| 4 | $n\text{-}C_{12}H_{25} . N(CH_2PO_3H_2)_2$ | Corrosion accelerated |
| 5 | $(CH_3)_2N(CH_2PO_3H_2)$ | 25 |
| 6 | $CH_3 . N(CH_2PO_3H_2)_2$ | 71 |
| 7 | $C_2H_5 . N(CH_2PO_3H_2)_2$ | 70 |
| 8 | $n\text{-}C_3H_7 . N(CH_2PO_3H_2)_2$ | 74 |
| 9 | $n\text{-}C_4H_9 . N(CH_2PO_3H_2)_2$ | 70 |
| 10 | $n\text{-}C_5H_{11} . N(CH_2PO_3H_2)_2$ | 67 |
| 11 | $CH_2{=}CH . CH_2N(CH_2PO_3H_2)_2$ | 68 |
| 12 | $p\text{-}CH_3 . C_6H_4 . N(CH_2PO_3H_2)_2$ | 45 |
| 13 | $C_6H_5 . CH_2 . N(CH_2PO_3H_2)_2$ | 55 |
| 14 | 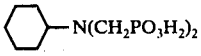 | 69 |

In this Table 1, Nos. 1-5 thus lie outside the invention, whereas Nos. 6-14 fall within the invention and show considerably better inhibiting properties.

We claim:

1. A process for inhibiting the attack of a corrosive water system on metals with which it comes into contact which comprises incorporating in the system a phosphonic acid of the general formula:

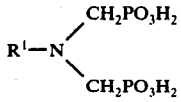

in which $R^1$ is a straight-chain alkyl group containing from 1 to 5 carbon atoms, an alkenyl group containing from 3 to 5 carbon atoms in which the double bond is not adjacent to the nitrogen, a tolyl group, a benzyl group or a cyclohexyl group.

2. A process as claimed in claim 1 for inhibiting the attack of a corrosive water system on metals wherein $R^1$ is a methyl, n-propyl, allyl, cyclohexyl, ethyl, n-butyl, n-pentyl, p-tolyl or benzyl group.

3. A process for inhibiting the attack of a corrosive water system on metals as claimed in claim 2 in which the amount of phosphonic acid in the corrosive water system is from 5 to 50 parts per million.

4. A process for inhibiting the attack of a corrosive water system on metals as claimed in claim 2 in which the phosphonic acid has the formula $$CH_3{-}N(CH_2PO_3H_2)_2.$$

5. A process for inhibiting the attack of a corrosive water system on metals as claimed in claim 2 in which the phosphonic acid has the formula $$n{-}C_3H_8{-}N(CH_2PO_3H_2)_2.$$

6. A process for inhibiting the attack of a corrosive water system on metals as claimed in claim 2 in which the phosphonic acid has the formula $$CH_2{=}CH{-}CH_2{-}N(CH_2PO_3H_2)_2.$$

7. A process for inhibiting the attack of a corrosive water system on metals as claimed in claim 2 in which the phosphonic acid has the formula

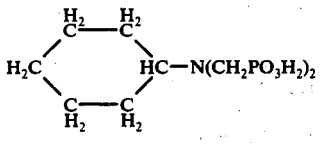

* * * * *